United States Patent [19]

Tesori

[11] Patent Number: 4,921,253

[45] Date of Patent: May 1, 1990

[54] GOLF CLUB

[76] Inventor: Charles A. Tesori, 432 Lillian Ave., Syracuse, N.Y. 13206

[21] Appl. No.: 321,627

[22] Filed: Mar. 9, 1989

[51] Int. Cl.[5] ..... A63B 53/04

[52] U.S. Cl. ..... 273/167 B; 273/167 G; 273/78; 273/167 F; 273/80 C

[58] Field of Search ..... 273/167–175, 273/80.2; D21/217, 219

[56] References Cited

U.S. PATENT DOCUMENTS

| | | | |
|---|---|---|---|
| D. 235,893 | 7/1975 | Becker | D21/217 |
| D. 291,343 | 8/1987 | Shearer | D21/219 |
| 3,085,804 | 4/1963 | Pieper | 273/167 B X |
| 3,578,332 | 5/1971 | Caldwell | 273/164 |
| 3,880,430 | 4/1975 | McCabe | 273/183 D |
| 4,010,958 | 3/1977 | Long | 273/164 |
| 4,240,636 | 12/1980 | Swenson | 273/169 |
| 4,508,350 | 4/1985 | Duclos | 273/183 D |
| 4,629,193 | 12/1986 | Pierman | 273/164 |
| 4,664,385 | 5/1987 | Macera | 273/167 B |
| 4,693,478 | 9/1987 | Long | 273/164 |
| 4,702,477 | 10/1987 | Solomon | 273/80 C |
| 4,741,535 | 5/1988 | Leonhardt | 273/164 |
| 4,747,599 | 5/1988 | Antonious | 273/167 G |

*Primary Examiner*—Edward M. Coven
*Assistant Examiner*—Sebastiano Passaniti
*Attorney, Agent, or Firm*—Wall and Roehrig

[57] ABSTRACT

A golf club for use around a putting green. The club head has an L-shaped configuration that is symmetrical about a vertical axis. The head includes a vertical wall having a horizontally disposed top surface and a horizontal wall extending behind the vertical wall. A center flange is located behind the vertical wall and contains a top surface that is co-planar with the top surface of the vertical wall. A pair of end flanges are located at the toe and heel ends of the horizontal wall immediately behind the front wall. A vertically disposed slot is passed downwardly between the vertical front wall and the three flanges to a depth such that the effective center of mass at the front striking face of the club lies below the center of a golf ball. The shaft of the golf club is passed downwardly into the center flange of the head and is positioned immediately behind the vertical wall of the club at about the effective center of mass. The club can thus be swung like a pendulum through an arc that lies in the plane of intended travel of the golf ball to impart overspin on the ball.

8 Claims, 1 Drawing Sheet

GOLF CLUB

BACKGROUND OF THE INVENTION

This invention relates to a golf club and in particular to a golf club with a symmetrical head that is suspended from a shaft so that the head swings in a pendulum like fashion to impart overspin to a golf ball.

Long, in U.S. Pat. No. 4,693,478, discusses in detail a mass distribution system for imparting a controlled amount of energy from the head of a putter to a golf ball to increase the rotational moment of inertia of the putter head to offset the head's tendency to twist in the event the ball is struck off center. As noted by Long, many putters are provided with weights at the toe and heel ends of the head which help to increase the moment of inertia of the head. Long, in addition to providing toe and heel weights, also removes a good deal of the head around its center of gravity in the region immediately behind the blade of the club. Accordingly, most of the force imparted to the ball from the weighted ends of the head is transferred through the sole plate of the club head. Long places the center of mass of the head at about the same height as the center of a golf ball when the club is held in a normal putting position. Accordingly, the ball can be launched forwardly with a sliding motion prior to its beginning to rotate. This can cause the ball to initially slide off line before it begins to roll true and thus miss the intended target despite proper stroking by the player.

It should also be noted that the shaft of the Long club is joined to the head at the heel end of the club, as in the case of many other conventional golf clubs. As a consequence, the club head is difficult to align and control throughout the swing, and any slight mis-positioning of the hands of the player will again cause the ball to be misdirected. Additionally, the center of mass of the Long head is offset some distance from the shaft which, again makes club alignment and accurate striking of the ball difficult to attain even for the most experienced of golfers.

U.S. Pat. No. 4,747,599 to Antonious and U.S. Pat. No, 4,702,477 to Solomon disclose putters similar in construction to that described by Long, wherein the shaft of the club is again joined to the head at the heel end thereof. Swenson in U.S. Pat. No. 4,240,636 discloses a club wherein the shaft is attached by an elongated extension arm to the head. Here again, this extension arm removes the shaft some distance from the center of mass of the club thereby making club alignment and accurate striking of the ball difficult. Additionally, the blade portion of the club described by Swenson is relatively thin behind the striking area and, as a consequence, the club does not provide a very "solid" feel to the golfer at impact. This solid feel is very important to let the golfer know if he is hitting a true and accurate shot.

Duclos in U.S. Pat. No. 4,508,350 and Pierman in U.S. Pat. No. 4,629,193 describe different putter configurations each of which has an aiming device to help improve the golfer's accuracy. Aiming devices of this type, however, cannot make up for club deficiencies or mis-hit balls.

OBJECTS AND SUMMARY OF THE INVENTION

It is therefore an object of the present invention to improve golf clubs and, in particular, to improve golf clubs for use on or around a putting green.

A further object of the present invention is to provide a golfer greater accuracy when playing around a putting green.

A still further object of the present invention is to provide a putter for imparting overspin to a golf ball when it is struck so that the ball rolls on a true line towards a desired target.

Another object of the present invention is to provide a golf club for use around a putting green which can be swung from the club shaft in a pendulum-like manner so that balls are consistently launched along a desired line of travel and track accurately towards a given target.

These and other objects of the present invention are attained by means of a golf club capable of imparting overspin to a golf ball that include a generally L-shaped head that is symmetrical about a vertical axis. The head includes a vertical wall having a horizontal top surface, a front face which defines a flat ball striking surface, and a horizontal wall that extends outwardly behind the vertical wall, the bottom surface of the horizontal wall defining the sole of the club head. A center flange, which is integral with the vertical and horizontal walls, is centrally located about the vertical axis of the head behind the vertical wall and contains a top surface that is co-planar with the top surface of the vertical wall. A pair of end flanges integral with the vertical and horizontal walls of the head are mounted at the toe and heel ends of the head. Each end flange is symmetrically positioned about the vertical axis of the head immediately behind the vertical wall to equally weight both ends of the head. The end flanges extend upwardly from the horizontal wall to a height that is slightly below the height of the top surface of the vertical wall. The head further includes a vertically disposed slot passing downwardly behind the vertical wall into three flanges to a uniform depth such that the distance from the sole of the head to the bottom of the slot is less than the radius of a golf ball. This moves the effective center of mass at the club face to a point where overspin is imparted to the golf ball when it is struck by the radius of club face. A shaft is connected to the center flange of the head so that the head may be swung like a pendulum within a vertical plane defining the path of travel of the ball.

BRIEF DESCRIPTION OF THE DRAWINGS

For a better understanding of these and other objects of the present invention, reference will be made to the following detailed description of the invention which is to be read in conjunction with the drawings, wherein.

DETAILED DESCRIPTION OF THE INVENTION

Figure 1:
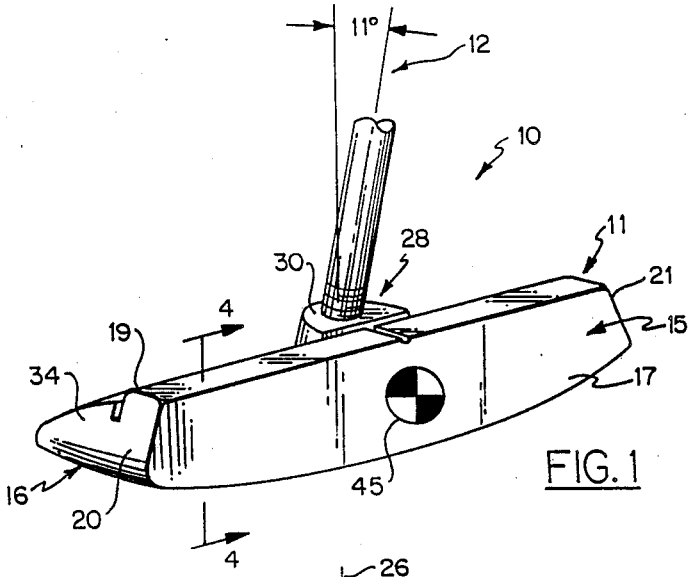
FIG. 1 is a perspective view of a putter embodying the teachings of the present invention.

Turning now to the drawing, and in particular to FIGS. 1–4, there is shown a putter, generally referenced 10, embodying the teachings of the present invention. The putter includes a one-piece cast metal head 11 and an elongated shaft 12 which, although not shown, terminates with a conventional grip that permits the golfer to firmly grasp the club. The club head is cast so that all the sections thereof are integrated one to the other.

Figure 2:
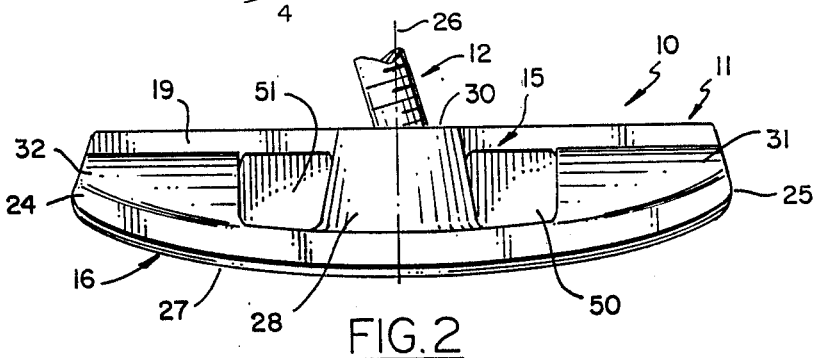
FIG. 2 is a rear view of the putter shown in FIG. 1.
Figure 3:
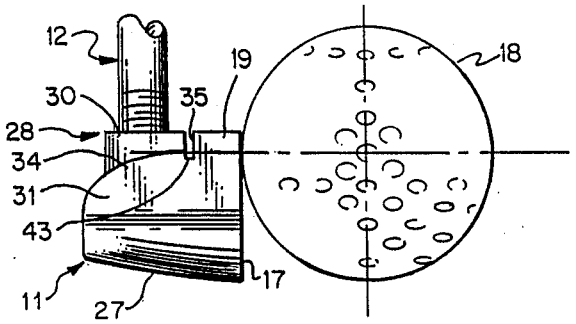
FIG. 3 is an end view of the putter shown in FIG. 1 aligned with a conventional size golf ball.
Figure 4:
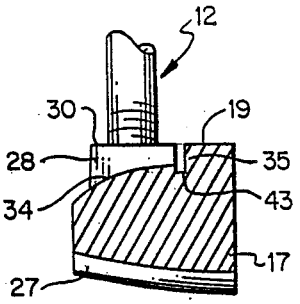
FIG. 4 is a partial sectional view taken along lines 4—4 in FIG. 1.

The head of the club is basically constructed in an L-shaped configuration having a vertical front wall 15 that is joined along its bottom edge to a horizontally disposed bottom wall 16 which extends to the rear of the front wall. The height of the vertical wall is substantially equal to the extended depth of the horizontal wall so that the mass of the two walls are about equal. The front face 17 of the vertical wall defines the striking surface of the club. As best seen in FIG. 3, the height of the front wall is slightly greater than the radius of the conventional size golf ball 18 used in this country and approved by the United States Golfers Association. The vertical wall further includes a flat top surface 19 that extends horizontally along the length of the club head from its toe end 20 to its heel end 21. The two ends 24 and 25 of the vertical wall are positioned equi-distance from the vertical axis 26 of the head and are inclined inwardly towards the vertical axis as shown in FIG. 2. The bottom surface 27 of the horizontal wall defines the sole of the club head. The sole is arcuate in form and has its center of curvature lying upon the vertical axis of the head. The radius of curvature is relatively large so that the arc described by the sole is correspondingly large. The shape of the sole permits the club to rest upon the ground with the club face in a generally vertical position.

As best seen in FIG. 2, the head includes a center flange 28 that is seated upon the horizontal wall immediately behind the vertical wall and is integral with both walls. The center flange is centered upon the vertical axis of the head and extends upwardly from the horizontal wall to a height equal to that of the front vertical wall. The top surface 30 of the center flange and the top surface 19 of the vertical wall both thus lie in a common plane.

A pair of end flanges are also seated upon the horizontal wall of the club head and include a toe flange 31 and a heel flange 32. The end flanges, like the center flange, are cast or otherwise formed so that they are also joined to both the vertical and horizontal walls of the club head. The size and shape of both end flanges is substantially the same. The end flanges are symmetrically positioned in regard to the vertical axis of the head so that their mass is equally distributed about the axis. Each end flange has a curved back wall 34 that extends between the vertical and horizontal walls to provide a streamline shape to the back of the club head.

It has been found that in order to effectively impart overspin to a golf ball, the effective center of mass at the striking surface should be situated below the center of the golf ball that is being struck. A vertical opening or slot 35 is formed in the club head immediately behind the vertical front wall. The slot is passed downwardly through the top of the center flange and the two end flanges to a uniform depth so that the bottom surface of the opening 43 lies in a horizontal plane that is perpendicular to the vertical axis of the head. By controlling the depth of the slot, the effective center of the mass at the striking surface can be accurately positioned.

Because the club head is symmetrical about its vertical axis, the effective center of mass, which is depicted at 45 in FIG. 1, lies somewhere along the vertical axis of the head. As can be seen, the deeper the slot formed between the front wall and the flanges, the lower the effective center of mass will occur on the striking face. The slot is brought to a depth such that the vertical distance from the bottom of the opening and the sole of the club measured along the vertical axis of the head is less than the radius of the golf ball. The effective center of mass thus occurs at a point that is below the center of the ball when the club is raised slightly off the ground by the golfer in a normal stroking position as described in greater detail in the previously noted Long patent. With the effective center of mass located beneath the center of the ball, an overspin is imparted to the ball immediately upon its being impacted by the striking face of the club. Accordingly, the ball is not allowed to slide along the ground before it starts to roll. Once launched with overspin, the ball will continue to track in true line along its intended path of travel, as it moves towards the target.

The shaft 12 of the club is connected to the club head by inserting the lower end of the shaft into a prepared receiving hole formed in the center flange of the club head. The receiving hole passes downwardly through the top surface of the center flange to a sufficient depth such that the end of the shaft is well anchored within the head. Preferably, a tight press fit is provided between the shaft and the flange so that the shaft is securely seated in the head and will not be able to work itself loose under normal playing conditions. A suitable bonding material may also be used between the shaft and the head to further secure the shaft in place.

The shaft is physically mounted in the center flange of the head as shown in FIGS. 1–4, so that the end of the shaft is located immediately behind the vertical wall of the club head close to the effective center of mass. The club thus act much like a weighted pendulum when it is swung in a normal manner by the golfer. Unlike other clubs, where the shaft is connected to the head near its heel or by means of an extended offset arm, the effective center of mass of the head and the head end of the shaft move together in a common plane defining the intended path of travel of the ball during the entire swing. This, coupled with the fact that the club imparts immediate overspin to the ball at impact, provide the golfer with greater accuracy than can be expected when using more conventional clubs.

The shaft can be offset at a slight angle towards the heel of the club as shown in FIG. 1. This slight offsetting does not affect the performance of the club, and in many cases, has proven to be helpful to the golfer. An offset of about eleven degrees is typical.

A pair of recesses 50 and 51 are formed in the back of the vertical wall between the center flange and the two end flanges. The recesses pass horizontally into the vertical wall and are used to control the overall weight or mass of the club head. The deeper the recesses, the lighter the club. Accordingly, the weight of the head can be adjusted to a particular player's needs without adversely effecting club performance. A typical club head will measure about four-and-one-quarter inches over the heel and the toe regions with the vertical and horizontal walls measuring about one inch at the center of the head. The average thickness of the two walls is between one-quarter and five-eighths of an inch. The weight of the head is about eleven ounces which provides for a good pendulum action and a solid feel to the golfer at impact. The distance from the sole of the club to the bottom of the slot formed in the flanges is approximately three-quarters of an inch or less when measured along the vertical axis of the head. The radius of curvature of the sole may be varied, however, the head should be able to rest evenly upon the ground to support the club in a generally vertical or upright position. Because of the way the weight of the head is distributed behind the striking surface or blade of the club and the location of the shaft within the club head, the club will not turn or twist at impact. Balls that are struck slightly off center tend to run truer and more accurately than when similarly struck by more conventional clubs having offset shafts and a higher center of mass.

Figure 5:
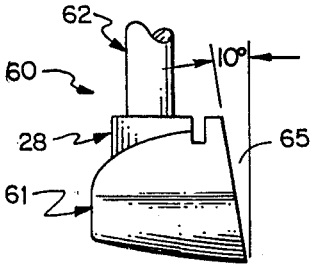
FIG. 5 is an end view of a second embodyment of the teachings of the present invention wherein the striking face of the club is inclined at a predetermined angle to impart loft to a golf ball.

FIG. 5 illustrates a club 60 having a head 61 and a shaft 62. The shaft and the head are constructed as explained above, however, the front face or striking portion of the head is provided with an inclined striking surface 65 that is designed to give some loft to the ball. The face typically will be inclined about ten degrees with respect to a vertical plane as shown in FIG. 5 so that the ball can be lofted over the fringe areas of a green as it is directed towards the target. Here again, because of the club construction, the club can be accurately swung within the plane of the desired intended path of travel of the ball and will roll on a true line truly across the putting surface towards the hole.

While this invention has been explained with reference to the structure disclosed herein, it is not confined to the details as set forth and this application is intended to cover any modifications and changes as may come within the scope of the following claims.

What is claimed is:

1. A golf club for striking a ball to impart overspin thereto that includes:

an L-shaped head that is symmetrical about a vertical axis, said head including a vertical wall having a horizontally disposed top surface and a front face defining a flat ball striking surface, and a horizontal wall that extends outwardly behind said vertical wall having a bottom surface defining the sole of the head, a center flange that is integral with the vertical and horizontal walls of the head, said center flange being centrally located about said vertical axis of the head behind the vertical wall and having a top surface that is substantially co-planar with the top surface of the vertical wall, a pair of end flanges that are integral with both the vertical and horizontal walls of the head that are located at the toe and heel end thereof, said end flanges being symmetrically positioned about the axis of said head behind the vertical wall so as to equally weight both ends of said head, said end flanges extending upwardly from the horizontal wall to a height about equal to that of the top surface of said vertical wall, said head further including a vertically disposed slot passing downwardly to a, predetermined depth, said slot passing through the two end flanges and the center flange to separate the flanges from the top section of the blade to move the effective center of mass of the club head below the bottom wall of the slot, the vertical distance from the sole of the head to the bottom wall of the slot being less that the radius of a golf ball and shaft means connected to the center flange of the head whereby the shaft is isolated from the blade of the head.

2. The golf club of claim 1 wherein the bottom surface of the horizontal wall is arcuate in form with the center of curvature of the surface lying on the vertical axis of said head.

3. The golf club of claim 1 wherein the shaft is inclined from the toe end of the club towards the heel end thereof to form an angle of about ten degrees with the vertical axis of said head.

4. The golf club of claim 1 wherein the front face of the head is aligned with the vertical axis of the head whereby little or no loft is imparted to a ball.

5. The golf club of claim 1 wherein the front face of the head forms an arcuate angle with the vertical axis of the head whereby a ball struck by the head is lofted.

6. The golf club of claim 1 wherein the height of the vertical wall is substantially equal to the depth of the horizontal wall.

7. The golf club of claim 1 that further includes a recess formed in the back of the vertical wall between the center flange and each end flanges, said recesses being symmetrically positioned about the central axis of the head whereby the weight of the head can be controlled by varying the depth of the recesses.

8. The golf club of claim 1 wherein said shaft means pass downwardly into the center flange.

* * * * *